United States Patent [19]
De Mattos
[11] 4,318,321
[45] Mar. 9, 1982

[54] CHEESE CUTTER WHEREIN LAST SLICE IS NOT SMALLER THAN DESIRED MINIMUM

[75] Inventor: David N. De Mattos, Wimbourne, England

[73] Assignee: Codat Management Limited, Wimbourne, England

[21] Appl. No.: 91,395

[22] Filed: Nov. 6, 1979

[51] Int. Cl.[3] ..... B26D 7/28

[52] U.S. Cl. ..... 83/71; 83/107; 83/152; 83/209; 83/212.1; 83/408

[58] Field of Search ..... 83/71, 209, 212.1, 278, 83/425.1, 152, 107, 408

[56] References Cited

U.S. PATENT DOCUMENTS

| | | | |
|---|---|---|---|
| 2,439,840 | 4/1948 | Buroff | 83/212.1 X |
| 2,660,962 | 12/1953 | Bloxham | 83/212.1 X |
| 3,170,355 | 2/1965 | Neely, Jr. | 83/364 X |
| 3,466,958 | 9/1969 | Munson | 83/71 |
| 3,599,689 | 8/1971 | Grant | 83/71 |
| 3,776,073 | 12/1973 | Runge | 83/212.1 |

*Primary Examiner*—James M. Meister
*Attorney, Agent, or Firm*—Scrivener, Clarke, Scrivener and Johnson

[57] ABSTRACT

A cutting apparatus for cutting blocks of e.g. cheese into portions for delivery to an automatic packaging machine comprises a platen 15 mounted on a hydraulic ram 16 which can be advanced in steps to force a block of cheese 14 located on the platen upward through fixed cutting wires mounted in a frame 17. After each advance of the platen a cutter 19 severs a layer of portions which are transferred to the packaging machine. Signals from a digital encoder 39 are supplied to a microprocessor which controls the steps in which the platen is advanced so that the block 14 is completely cut into portions none of which in thinner than a predetermined thickness whereby remnant waste is eliminated.

6 Claims, 7 Drawing Figures

CHEESE CUTTER WHEREIN LAST SLICE IS NOT SMALLER THAN DESIRED MINIMUM

This invention is concerned with apparatus for use in the packaging of portions of cheese or other soft non-granular substances such as fat or meat loaf.

Cheese is produced in parallelepiped blocks, generally of the order of 18 kg weight. For distribution and retail sale these blocks require to be cut into portions, each portion being individually and separately packed. Automatic vacuum packaging machines are known which have a matrix of compartments each for a single portion of cheese and which operate to pack portions of cheese loaded in the matrix in plastic film wrapping material.

According to one aspect of the present invention there is provided apparatus for cutting a block of a soft non-granular substance into a plurality of portions, the apparatus comprising a platen to receive a block to be cut; drive means for advancing the platen from a starting position in steps to a fully advanced position; first cutter means for cutting into the block along the direction of advance of the block on the platen; and second cutter means for cutting the block in a direction transverse to the cuts produced by the first cutter means whereby operation of the first and second cutter means produces a layer of portions cut from the block, the drive means being adjustable to set the size of steps in which the platen advances, and thus the thickness of the layer of portions produced, such that the block is divided completely into a plurality of layers none of which has a thickness less than a predetermined minimum.

The preferred embodiment of such apparatus can be used to cut a block of cheese for loading into an automatic packaging machine.

Preferably the apparatus includes a transfer mechanism for transferring portions to a packaging machine, the mechanism comprising a plurality of heads each having a face for engaging a portion to be transferred, port means in that face, and means to couple the port means to a source of sub-atmospheric pressure, the plurality of heads being located in each of at least two parallel rows, the heads of each row being movably mounted on a carrier and the carriers being mounted on supports, the carriers being movable between a first position at a first spacing on the supports to a second position at a second spacing from one another and the heads on each carrier being movable between a first spacing at the first position of the associated carrier to a second spacing on the carrier at the second position of the carrier, whereby in a first location closely packed portions can be engaged by the heads and transferred to a second location in a spaced apart relationship to one another.

The heads of the transfer mechanism are intended to provide the clamping heads of the cutting apparatus and to transfer the rows of cut portions to the matrix of lined compartments of a wrapping machine.

The suction heads for use in a transfer mechanism preferably comprise a manifold for connection to a source of sub-atmospheric pressure, a plurality of cups each having an open mouth lying in a gripping surface of the head, and an aperture establishing communication between each cup and the manifold, the cross-sectional area of each aperture being small in comparison with the area of the mouth of the cup it serves.

The invention will be better understood from the following description of a preferred embodiment thereof, given by way of example only, reference being had to the accompanying drawings, in which.

Figure 1:
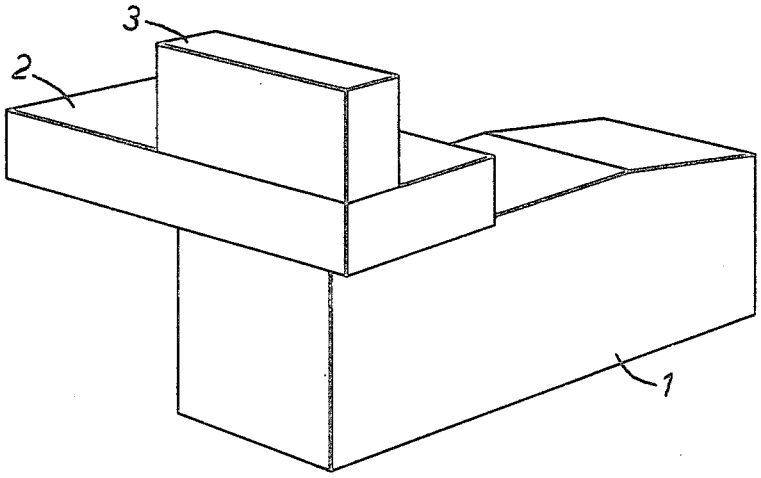
FIG. 1 is a block perspective view of an embodiment of apparatus according to the present invention.
Figure 2:
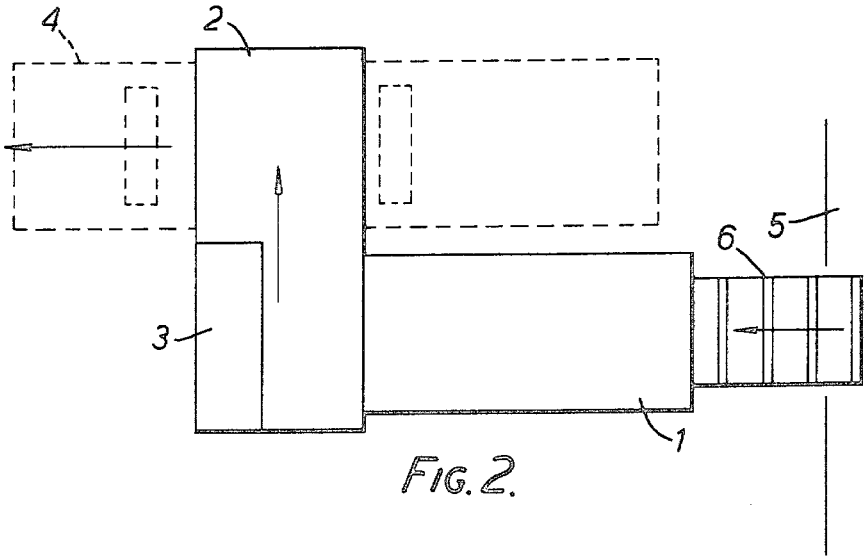
FIG. 2 is a plan view of the apparatus shown in FIG. 1.

Referring firstly to FIGS. 1 and 2, a preferred embodiment of the invention is shown which comprises a feed and cutter unit 1, a transfer unit 2, and a control cubicle 3. The apparatus functions to receive blocks of, for example, cheese and to reduce them to a multiplicity of portions which are delivered to an automatic vacuum packaging machine 4 situated below one end of the transfer unit 2.

In use, blocks of cheese are removed from their wrappings in a stripping room 5 and are placed on a gravity feed conveyor 6 leading to the cutter unit 1. The blocks are taken successively from the conveyor 6 and passed through the cutter unit 1 in which they are cut completely into usable portions none of which has a thickness less than a predetermined minimum. Cut portions are removed from the cutter unit by the transfer unit 2 and deposited in the packaging machine 4 for vacuum wrapping.

Figure 3:
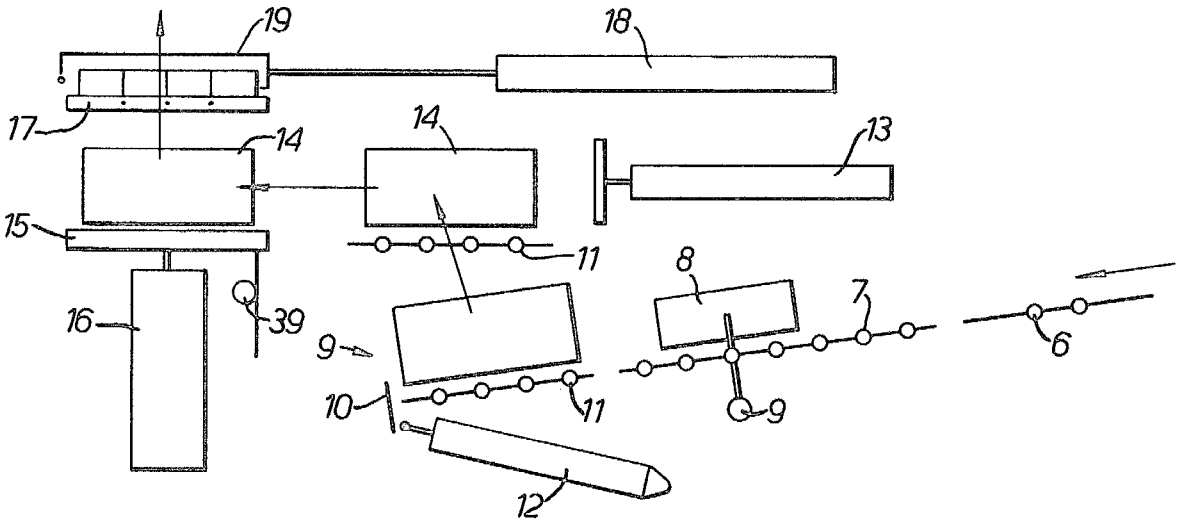
FIG. 3 is a schematic side elevational view of the cutter unit of the apparatus of FIGS. 1 and 2.
Figure 4:
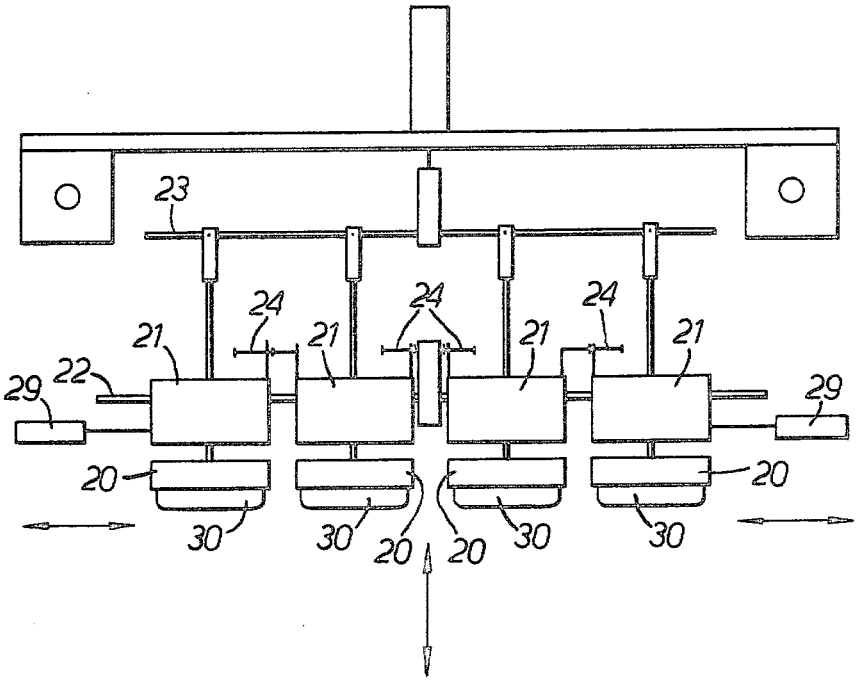
FIG. 4 is a schematic elevational view of the transfer unit of the apparatus of FIGS. 1 and 2.

Referring now to FIG. 3 the cutter unit 1 and gravity conveyor 6 are shown schematically in side elevation. In use, the leading block of cheese on the conveyor 6 passes on to a conveyor 7 of the cutter unit and is held there until required by clamps 8. The clamps 8 are powered by a pneumatic ram 9 and are connected by a centering linkage such that the block held between the clamps 8 is centered on the conveyor 7. When required, the cylinder 9 is operated to release the clamps 8 and allow a block of cheese to roll foward into a loading gate 9' where it arrested by a stop 10. The loading gate comprises a short length of conveyor 11 which is mounted by a linkage to be vertically movable between the lower and upper positions illustrated in FIG. 3. Movement of the conveyor 11 is controlled by a pneumatic ram 12. When required, the ram 12 is operated to raise a block of cheese mounted on the conveyor section 11 to the upper position illustrated in FIG. 3 whereupon a further pneumatic ram 13 is operated to force the block of cheese 14 forward onto a platen 15. If desired, side trimming wires can be position to trim the sides of the block as it is forced forward by the ram 13. However, this should not be necessary unless the sides of the block are badly barrelled. The platen 15 is then raised by admitting hydraulic fluid to a hydraulic ram 16 until the top surface of the block of cheese located on the platen breaks a photo-optical beam. By measuring the position of the platen at this instant, the thickness of the block of cheese is determinable. The platen 15 is then raised in a plurality of steps under program control (as hereinafter described) to force the block of cheese through a fixed cutting frame 17. The cutting frame 17 is provided with an intersecting grid-pattern of cutting wires to divide the block vertically into a plurality of columns. In the preferred embodiment of the invention a block is divided into twelve rectangular columns by means of cutting wires intersecting at right angles. After each upward step of the ram 16 a pick-up head of the transfer mechanism decends into contact with each of the columns of cheese, and a pneumatic ram 18 is operated to move a slicer 19 whereby a layer is cut from the top of the block of cheese. Since the block of cheese has, at the level of the slicer, been divided vertically into columns the layer cut by the slicer will comprise a plurality of individual portions which are then removed from the top of the block by the transfer unit. The slicer 19 is then retracted by the ram 18 and the ram 16 advanced a further step to raise the block of cheese. The thickness of the layers cut by the slicer 19 is determined by the size of the steps in which the ram 16 advances as will be described in more detail hereinafter.

The slicer preferably comprises a rigid frame to which is secured a single cutting wire.

After the last layer of portions has been removed from the platen the platen automatically decends to receive another full block of cheese.

Figure 5A:
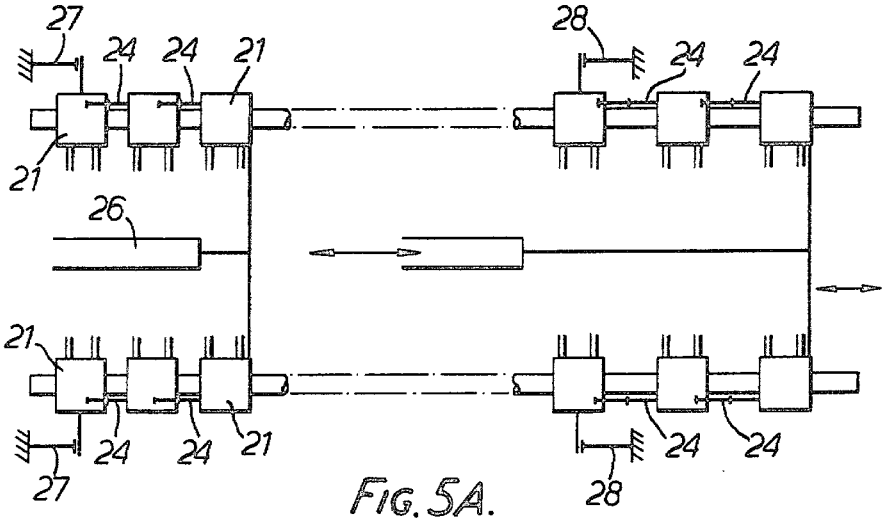
FIGS. 5A and 5B are schematic plan views showing operation of the transfer unit.
Figure 5B:
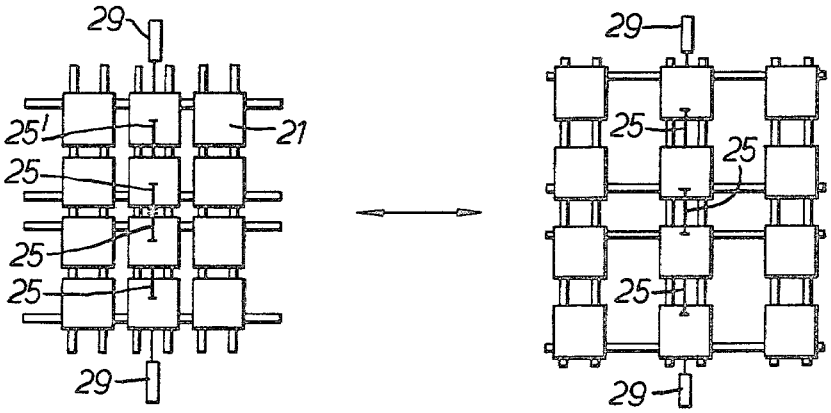

The transfer unit comprises a plurality of pick-up heads mounted so as to be horizontally movable with respect to each other. One head is provided for each grid square of the fixed cutting frame 17 and accordingly each pick-up head removes a single portion of cheese after a layer of cheese has been severed by the slicer 19. The pick-up heads 20 are mounted on blocks 21 which in turn are slidably mounted on rods 22,23. The arrangement is such that the blocks 21 can slide relative to each other within predetermined limits in two mutually perpendicular directions. The extent of permissible travel is determined by lost motion connections 24 and 25. Means are provided for raising and lowering the pick-up heads 20 and for displacing the entire assembly of pick-up heads horizontally. Referring to FIGS. 5A and 5B the operation of the transfer unit is illustrated. Initially, the blocks 21 and accordingly the pick-up heads 20 are at their minimum mutual spacing and are located directly above the block of cheese on the platen. The pick-up heads are driven downwards into engagement with the top surface of the columns of cheese and grip the cheese as is described hereinafter. After the slicer 19 is operated the pick-up heads are raised to remove a layer of portions from the top surface of the remainder of the block of cheese and a pneumatic ram 26 is operated to move the blocks 21, pickup heads 20, and gripped portions of cheese to a position above the packaging machine. In the interests of clarity, only six blocks 21 are illustrated in FIG. 5A, these blocks being illustrated in two different positions. The initial position on the left of FIG. 5A illustrates the spacing of the blocks above the block of cheese, the ram 26 being fully retracted and the left hand blocks 21 being restrained by fixed stops 27. The lost motion connections 24 are fully contracted and the blocks 21 are close together. Upon actuation of the ram 26 the blocks 21 are moved to the right as viewed in FIG. 5A to a position above the packaging machine. The left most blocks 21 eventually engage fixed stops 28 and further extension of the ram 26 serves to move the blocks 21 apart to the limit of the lost motion connections 24.

Similarly, referring to FIG. 5B, in the initial position of the blocks 21 above the block of cheese pneumatic rams 29 are fully advanced to position the blocks 21 as close together as possible. As the blocks are moved to the right as viewed in FIGS. 5A and 5B by the ram 26 as described above the rams 29 are retracted to move the blocks 21 apart to the limit of the lost motion connections 25. The net result is that when the blocks 21 pick-up heads 20, and portions of cheese arrive above the packaging machine the portions of cheese are spaced apart to the same dimensions as the packing matrix of the packing machine. Accordingly, the portions of cheese can be dropped directly into the matrix of the packaging machine.

In a modified embodiment (not shown) the rams 29 are dispensed with and a cam track is provided for separating the blocks 21 in the direction perpendicular to the axis of the ram 26.

The pick-up heads are readily accessible to an operator and the surface of the head which comes into contact with the cheese can be wiped over without removal from the machine. To provide for washing and sterilization the heads can be removed individually.

In the preferred embodiment of the invention the pick-up heads 20 each comprise a resilient pad 30 moulded from a suitable elastomeric material to define a plurality, e.g. 36, cups on the lower face thereof. Each cup is connected to a manifold defined within the pick-up heads by a short metal tube extending from a recess at the closed end of each cup into the manifold. The cross sectional area of each tube is much smaller than the opening to each cup defined at the lower surface of the pads 30. As a result, when the pick-up head manifolds are connected to a sub-atmospheric source a small amount of air is drawn through the tubes. If the lower surfaces of the pads 30 are in contact with a block of cheese the cups are sealed by the block of cheese and a vacuum is formed within each cup. If, however, any cup is not sealed only a small amount of air can be drawn through the tube associated with that cup because of the small diameter of the tube. Each pick-up head is accordingly capable of lifting a block of cheese, but if for some reason not all the cups of a head seal on the block of cheese no serious leakage of air into the manifold of that pad will occur. The vacuum system is arranged such that vacuum is supplied to the manifolds of the pick-up heads as they are driven down into contact with the top surface of the cheese.

Figure 6:
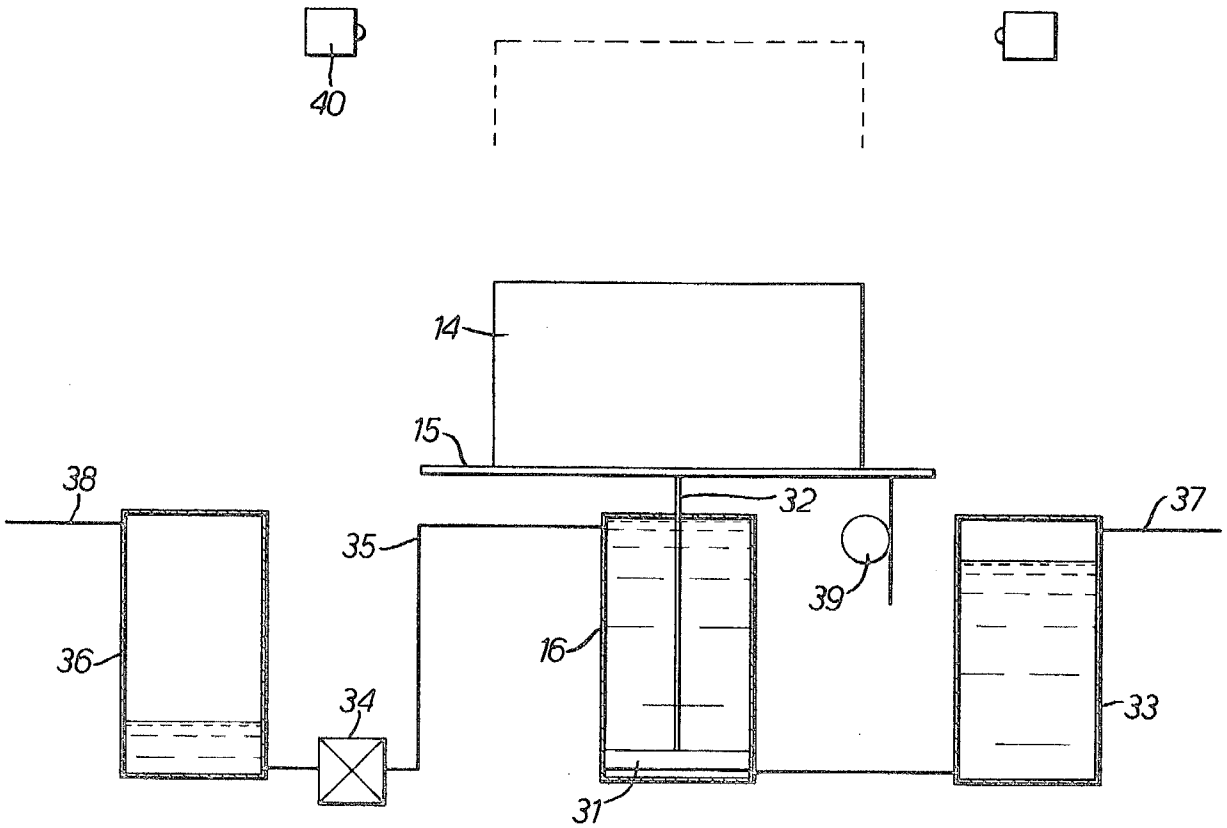
FIG. 6 is a schematic view of a portion of the apparatus of FIGS. 1 and 2.

Referring now to FIG. 6 the mechanism for controlling the height of the platen 15 is shown in more detail. The ram 16 is a double acting hydraulic ram having a piston 31 upon the piston rod 32 of which the platen 15 is directly mounted. Raising of the platen is accomplished by admitting hydraulic fluid from a reservoir 33 to the underside of the piston 31, the movement of the piston being controlled by an electrically operated hydraulic valve 34 positioned in a pipe 35 connecting the upper chamber of the ram 16 (as viewed in FIG. 6) to a reservoir 36. During the raising phase of operation of the ram 16 compressed air is continuously applied to the inlet 37 of the reservoir 33 whilst the outlet 38 of the reservoir 36 is vented to atmosphere. Accordingly, movement of the piston 31 is controlled exclusively by opening and closing the valve 34.

A digital encoder mechanism 39 of any convenient type, for example, Litton Precision Products International Inc. encoder type 70B item 500-1-3-1 is connected to the platen in order to provide a train of output pulses upon movement of the platen 15. In the preferred embodiment one output pulse is produced for each 0.1 mm vertical movement of the platen 15. The output pulses from the digital encoder 39 are supplied to a microprocessor control unit housed within the control cubicle 3.

Although blocks of cheese supplied to the machine are manufactured to the same nominal dimensions it will be appreciated that the actual dimensions of the blocks vary considerably. As a result, if a plurality of slices of a predetermined thickness are cut from a block, a remnant layer of random thickness will be left. If this remnant layer is too thin for packaging it must be regarded as waste and used, for example, in the production of processed cheese. Not only is this a less profitable use for the cheese, but also means that the remnant layer must often be removed from the machine by hand, resulting in an interruption to automatic operation.

In the preferred embodiment of the present invention the apparatus is programmed to cut as many slices as possible of a desired thickness, whilst ensuring that the remnant layer produced is never less than a usable thickness. In other words, the block is always completely divided into portions sufficiently thick for automatic wrapping, thereby substantially completely eliminating waste and the associated interruptions to production. In the preferred embodiment of the present invention, to produce the optimum portions from the random remnant of the block after as many portions of the desired thickness as possible have been cut, the feed mechanism ensures that the last two portion layers are always in excess of a selected minimum thickness and never above twice this thickness. For example, if 25 mm is the desired thickness and 10 mm the minimum, from a block of 180 mm the equipment would cut six layers of 25 mm and two of 15 mm: from a 175 mm block the last two layers would be 12.5 mm, and from 165 mm there would be six layers of 25 mm and one final layer of 15 mm. From a block of 158 mm, five layers of 25 mm would be cut and two of 16.5 mm.

As previously mentioned, control of the thickness of each portion is achieved by means of a micro-processor unit which receives signals from the digital encoder 39 and in response opens and closes the hydraulic valve 34. When a new block of cheese is loaded on the platen 15, the platen is in its lowest position. The valve 34 is then opened and the platen is allowed to rise until the upper surface of the block of cheese interrupts the beam of a photo-optical sensor 40. The micro-processor has previously been programed with the total number of pulses from the digital encoder 39 which correspond to the maximum overall vertical movement of the platen 15. By deducting from this total the number of pulses produced during raising of the platen 15 until the cheese intercepts the photo-optical beam, the resultant number of pulses corresponds to the height of the block 14. The valve 34 is then closed to stop the platen 15. The desired slice thickness and the minimum acceptable slice thickness have previously been set on the control cubicle by means of, for example, thumbwheel switches. The valve 34 is then opened and the platen 15 rises until the number of pulses emitted by the digital encoder corresponds to the desired slice thickness plus the offset between the photo-optical beam and the cutting wire of the slicer 19. The valve 34 is again closed. This step in the movement of the platen will have forced the cheese up through the fixed cutting frame 17 to produce a plurality of columns each of which extends above the plane of the cutting wire of the slicer by an amount equal to the desired thickness. The slicer 19 is then operated and the first layer of portions removed as described above. The valve 34 is again opened and the cheese forced upwardly until the number of pulses emitted by the digital encoder corresponds to the desired slice thickness. The valve 34 is then closed and the slicer 19 operated again.

This process continues until the cheese remaining on the platen 15 has a thickness determined by subtracting the total number of pulses emitted by the digital encoder 39 from the number of pulses corresponding to the maximum possible movement of the platen 15, less than the desired portion thickness plus the minimum acceptable portion thickness. At this stage, it is necessary to determine whether the remnant remaining on the platen can be cut into two equal portions each having a size greater than the minimum permissible thickness or whether it must be removed in one slice. This is carried out by dividing the number of pulses corresponding to the thickness of cheese remaining on the platen by two, and comparing the result with the number of pulses corresponding to the minimum acceptable thickness. If as a result it is determined that the operation of cheese remaining on the platen can be divided into two layers each having a thickness greater than the minimum acceptable thickness, the valve 34 is opened to advance the platform an appropriate distance, after which the slicer 19 is operated, and then to fully advance the platen after which the remaining portions on the platform are removed without operation of the slicer 19. If in the alternative the cheese remaining on the platen must be removed as a single layer the valve 34 is opened to allow the platen to become fully advanced, and the portions remaining on the platen are then removed without operation of the slicer 19.

Conveniently, operation of the entire machine is under the control of the micro-processor, with each movement of the machine being monitored by suitable photo-optical or magnetic sensors. These sensors ensure that each motion or function is correctly performed, and result in the initiation of a suitable error procedure in the event of any malfunction. The cutting apparatus is preferably electrically connected to the packaging machine in order to ensure correctly phased operation.

Although the control cubicle 3 is preferably mounted on the machine it may, if desired, be mounted away from the cutter unit and transfer unit and be connected to these units by suitable cables. In addition to the normal automatic control of the machine the control cubicle preferably allows for manual operation of each portion of the machine to facilitate the clearing of faults and the initial setting up of the machine. In the preferred embodiment in which the digital encoder emits one pulse for each 0.1 mm of movement of the platen, the desired portion thickness and minimum acceptable thickness can conveniently be adjusted in steps of 0.1 mm. The machine is preferably provided with guards whereby the moving parts are inaccessible. The guards may be removed for cleaning and maintenance purposes but are provided with fail-safe air operated interlocks such that removal of any guard breaks an air line resulting in the operation of one or more diaphragm switches to shut down the machine. A stand-by low pressure air supply to the pick-up heads and the clamping cylinder 9 is provided in order to prevent the inadvertent dropping of portions of cheese or the entry of further blocks of cheese into the machine in the event of automatic shutdown of the machine.

The control apparatus of the machine preferably provides for a second mode of operation in which after the height of the block of cheese has been measured as described above, the block of cheese is completely advanced in a plurality of steps each of equal size whereby the block is divided into a plurality of equal sized portions. In this case, the controller is programed with the number of slices into which the block is to be divided.

I claim:

1. Apparatus for cutting a block of a soft non-granular substance into a plurality of portions, the apparatus comprising a platen to receive a block to be cut; drive means for advancing the platen from a starting position in steps to a fully advanced position; first cutter means for cutting into the block along the direction of advance of the block on the platen; second cutter means for cutting the block in a direction transverse to the cuts produced by the first cutter means whereby operation of the first and second cutter means produces a layer of portions cut from the block, and control means for controlling the size of the steps in which the platen is advanced by the drive means, and thus the thickness of the layer of portions produced, such that the block is completely divided over its entire length, first, into a plurality of layers of specified thickness, each of said layers being of equal thickness and second, into at least one remainder layer having a thickness which is less than the sum of the specified thickness and a minimum thickness but not less than said minimum thickness, said minimum thickness being chosen without reference to said specified thickness, the latter being greater than said minimum thickness, said control means determining whether said remainder layer can be cut into two layers of equal thickness both greater than the minimum thickness, and in the event that the remainder can be so cut, said control means advances the platen for the remainder to be cut accordingly, but if the remainder cannot be cut into two equal layers both greater than said minimum thickness then said control means advances said platen to its fully advanced position without said remainder being so cut.

2. Apparatus according to claim 1 wherein the starting position of the platen is intermediate the fully advanced position and a fully retracted position of the platen and the drive means is operable to advance the platen from its fully retracted position to the starting position prior to advancing the platen from the starting position in steps to the fully advanced position and to return the platen to the fully retracted position after it has reached the fully advanced position.

3. Apparatus according to claim 2 including a sensor which is triggered when the leading surface of a block located on the advancing platen reaches a predetermined datum position, the starting position of the platen being the position of the platen when the sensor is triggered.

4. Apparatus according to claim 1, 2 or 3 including a transfer mechanism comprising a plurality of heads each having a face for engaging a portion cut from the block, port means in that face and means to couple the port means to a source of sub-atmospheric pressure, and drive means, a plurality of heads being located in each of at least two parallel rows, the heads of each row being movably mounted on a carrier and the carriers being mounted on supports, the carriers being movable between a first position at a first spacing on the supports to a second position at a second spacing from one another and the heads on each carrier being movable between a first spacing at the first position of the associated carrier to a second spacing on the carrier at the second position of that carrier, whereby in a first location items in a first relationship to one another can be engaged by the heads at their first position at the first position of the carriers and transferred to a second location in a second relationship to one another.

5. Apparatus according to claim 4 wherin each head comprises a manifold for connection to a source of subatmospheric pressure, a plurality of cups each having an open mouth lying in a gripping surface of the head, and an aperture establishing communication between each cup and the manifold, the cross-sectional area of each aperture being small in comparison with the area of the mouth of the cup it serves.

6. Apparatus according the claim 5 wherein the cups are formed as an integral resilient member detachably secured to the manifold.

* * * * *